US005509594A

United States Patent [19]

Maggioni

[11] Patent Number: 5,509,594

[45] Date of Patent: Apr. 23, 1996

[54] DEVICE TO CONTROL THE FEEDING OF THE STRAP IN A STRAPPING MACHINE

[75] Inventor: Cesarino Maggioni, Borgomanero, Italy

[73] Assignee: Officina Meccanica Sestese S.p.A., Paruzzaro, Italy

[21] Appl. No.: 171,414

[22] Filed: Dec. 22, 1993

[30] Foreign Application Priority Data

Dec. 23, 1992 [IT] Italy ..... MI92A2956

[51] Int. Cl.[6] ..... B65H 23/188; B65H 20/36; B65B 13/22

[52] U.S. Cl. ..... 226/35; 100/4; 100/32; 226/181

[58] Field of Search ..... 226/34, 35, 154, 226/155, 181, 183; 100/4, 32

[56] References Cited

U.S. PATENT DOCUMENTS

| | | | |
|---|---|---|---|
| 3,086,451 | 4/1963 | Van Der Wal | 226/181 X |
| 3,088,397 | 5/1963 | Martin et al. | 100/26 |
| 3,677,555 | 7/1972 | Vail et al. | 226/187 X |
| 3,949,662 | 4/1976 | Woomer | 100/4 |
| 4,202,468 | 5/1980 | Anderson et al. | 226/68 X |
| 4,516,488 | 5/1985 | Bartzick et al. | 100/32 X |
| 4,540,324 | 9/1985 | Kogane et al. | 226/11 X |
| 4,910,945 | 3/1990 | Fujii et al. | 100/32 X |
| 4,952,270 | 8/1990 | Sakaki et al. | 100/32 X |
| 5,024,149 | 6/1991 | Kato | 100/32 |
| 5,372,321 | 12/1994 | Ohkubo et al. | 226/181 X |
| 5,379,576 | 1/1995 | Koyama | 100/32 X |

FOREIGN PATENT DOCUMENTS

| | | |
|---|---|---|
| 0061620 | 10/1982 | European Pat. Off. . |
| 2621555 | 4/1989 | France . |

*Primary Examiner*—John M. Jillions
*Attorney, Agent, or Firm*—Young & Thompson

[57] ABSTRACT

Device to control the feeding of the strap in a strapping machine, of the type wherein the strap (R) is guided on the periphery of at least one driving wheel (1) and at least one pressure wheel (4) is provided to press the strap (R) against the periphery of said driving wheel (1) so as to guarantee its feeding. An arm (8) is provided to oscillate between a guiding position, in which the arm at least partly surrounds the periphery of the driving wheel (1) so as to form a guiding channel (C3) for the strap (R), and an opening position of release, away from the driving wheel (1), into which the arm is moved by said strap when it stops, and in which it controls the removal of the pressure wheel (4) so as to release the feeding pressure. The oscillating arm (8) extends, beyond its part surrounding the periphery of the driving wheel (1), into a counter-bent portion which determines a saddle path (C4) for the strap (R).

15 Claims, 6 Drawing Sheets

DEVICE TO CONTROL THE FEEDING OF THE STRAP IN A STRAPPING MACHINE

BACKGROUND OF THE INVENTION

1. Field of the Invention

The present invention concerns a strapping machine and, more particularly, a device to control the feeding of the strap, allowing a more precise and rapid control of the strap stopping or speed-changing function.

As known, machines of this type comprise the drive means which draw the strap from a reel, launch it into a special guide track around the product to be packed, and then recover it—after its leading end has been blocked or clamped—so as to wind it around the product with a reset tension. Further means then provide to tie and cut the strap after its windup.

It is also known that modern packing technique requires, on one hand, short operating times and thus high strap launching and recovery speeds and, on the other hand, the possibility to regulate the tensioning of the strap to a wide extent. However, there two requirements are often scarely compatible.

2. Description of the Prior Art

A strapping machine which tries to satisfy both these requirements is described, for example, in the Italian Patent No. 1,135,722, filed on Mar. 24, 1981, by the same Applicant, to which reference is made herein for a better understanding of the present invention. This machine has turned out to be more than satisfactory for many years, but it is no longer apt to fully satisfy the present requirements of packing speed.

One of the problems arising with the increase of the strap feeding speed is its instant and prompt stopping at the end of the launching stroke and, respectively, at the end of the recovery stroke.

As known, the strap is moved forward between a driving wheel and an idle pressure wheel. During launching, when the leading end of the strap reaches the stop, it is blocked in correspondence of the clamping gripper where it operates a microswitch which controls the stopping of the drive motor. Although there are known to be several arrangements which try to guarantee an instant stopping, in practice, the inertia of the rotating masses of the driving unit causes—at the high speeds currently requested—irregular behaviours. In particular, as a result of its residual drag, the strap tends to curl up or form a loop along its path between the driving wheel and its blocked leading end.

According to the teaching of FR-A-2,621,555, or of U.S. Pat. No. 3,949,662, said loop formed by the strap is used to cause the lifting of an oscillating guide, which partly surrounds the driving wheel and which in turn operates a switch to stop the main drive motor.

The actual advantage of these known arrangements is that the strap does not wedge into the feeding path and does not hence create any jamming, in that it freely extends forming said loop. Nevertheless, said arrangements provide no advantages as far as the prompt, instant, stopping of the strap feeding stroke, since it is evident that the switch operated by the oscillating guide—when this latter is moved by the loop being formed by the strap—anyhow operates at a moment which is subsequent to that of operation of the microswitch controlled by the leading end of the strap reaching the clamping gripper.

Furthermore, both of the arrangements known from the aforecited patents merely operate during launching of the strap.

A similar problem arises however during the fast recovery of the strap: in fact, the residual drag causes an undesired tightening of the strap around the product to be packed, at a tension higher than that expected, which can often cause damage to the product being packed.

SUMMARY OF THE INVENTION

The object of the present invention is to realize a device allowing to instantly stop the strap, both during launching and during recovery thereof. In a strapping machine—of the type wherein the strap is guided on the periphery of at least one driving wheel and at least one pressure wheel is provided to press the strap against the periphery of the driving wheel so as to guarantee its feeding, and comprising also an arm oscillating between a guiding position, in which it at least partly surrounds the periphery of said driving wheel so as to form a guiding channel for the strap, and an opening position of release, away from the driving wheel, into which it is moved by said strap and in which it controls the stopping of said driving wheel—the above object is reached thanks to the fact that said pressure wheel is associated to said oscillating arm and is moved away from the driving wheel, so as to release the feeding pressure, when the arm is moved into said opening position.

According to a first characteristic of the present invention, the oscillating arm moves into an opening position of release, at the end of the launching stroke, thanks to a loop being formed by the strap—in known manner—between the periphery of the driving wheel and said oscillating arm.

According to a further important characteristic of the invention, said oscillating arm extends, beyond its part surrounding the periphery of the driving wheel, into a counter-bent portion which determines a saddle path for the strap, thanks to which said arm moves into an opening position of release also during strap recovery, in response to the tensioning of the strap along said saddle path.

In other words, the arrangement according to the present invention allows an instant and prompt opening of the oscillating arm, with a consequent removal of the pressure wheel and, hence, release of its feeding pressure; furthermore, this occurs both during launching of the strap, due to forming of the loop, and during recovery thereof, due to tensioning of said strap.

BRIEF DESCRIPTION OF THE DRAWINGS

Further characteristics and advantages of the device according to the invention will anyhow be more evident from the following detailed description of a preferred embodiment thereof, given by way of example and illustrated on the accompanying drawings, in which.

DESCRIPTION OF THE PREFERRED EMBODIMENT

As it appears evident from the drawings, the control device according to the invention comprises a main driving wheel 1 and a secondary wheel 2—rotating in synchronism but in opposite directions—on the periphery of which is guided the strap R. During launching of the strap, the wheels move according to the arrows F, and during its recovery they move in the opposite sense.

The strap slides along a path including a first channel section C1 around the wheel 2, a second straight channel section C2 leading from the wheel 2 to the wheel 1 and being tangent to both, a third channel section C3 around the wheel 1, a fourth saddle-shaped channel section C4 radiused to the outlet of the channel section C3 from the wheel 1, and finally a last channel section C5 leading to the normal guiding track (not shown) around the product to be packed.

A pressure wheel 4 bears against the periphery of the driving wheel 1 so as to press the strap R against wheel 1 and thereby guarantee its dragging and thus the feeding of the strap.

Figure 1A:
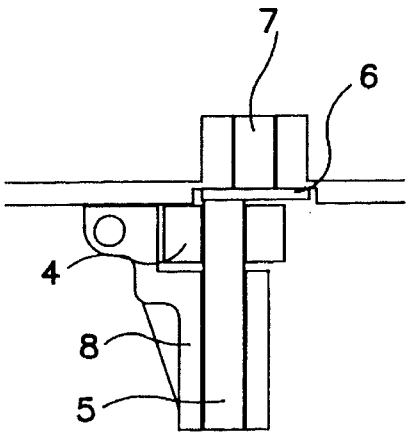
FIG. 1*a* shows the detail of the eccentric shaft supporting the oscillating arm of the control device of FIG. 1.

The wheel 4 is mounted freely rotating on a shaft 5 fixed onto a plate 6, said shaft being eccentric in respect of the axis 7 about which said plate 6 is rotatable (see FIG. 1*a*). On the same shaft 5 there is also mounted rotating an oscillating arm 8.

On the plate 6 there is also fixed a square support bracket 9. A spring 10, whose pressure is adjustable by means of an adjusting screw 11, acts onto a first arm of bracket 9. Onto the other arm of bracket 9 there are mounted a thrust spring 12 and a stop finger 13, this latter being adjustable by means of an adjusting screw 13*a*.

The arrangement is such that the pressure spring 10 imparts, by way of the square support bracket 9, a pressure onto the plate 6 which causes its clockwise rotation. Said rotation leads the wheel 4 to bear against the driving wheel 1 and impart a pressure on the strap R, sufficient to ensure the dragging and feeding thereof. The bearing of the wheel 4 against the wheel 1 also determines the working position of the bracket 9 during feeding of the strap.

The oscillating arm 8 is apt to form—with a first portion curved with a bending radius substantially corresponding to the radius of the wheel 1—the section C3 of the guiding channel for the strap R. It then forms—with a second counter-bent portion (i.e. bending in a sense opposite to that of the first portion) and in cooperation with a fixed bottom saddle-shaped seat—the section C4 of the guiding channel for the strap.

To allow the strap R to be always correctly guided into the channel sections C3 and C4, taking into account its variable thickness, the arm 8 is provided with two adjustment means:

on one hand, it comprises a tailpiece 8*a*, apt to cooperate with the aforecited stop finger 13;

on the other hand, it comprises a protuberance having a slot 8*b*, into which is housed a stop 14 in the form of a cam.

By adjusting the cam 14—against which the arm 8 is pressed by the spring 12—it is possible to regulate the minimum opening of the channel C3-C4, while the adjustment of the stop finger 13 determines its maximum opening. Between these two minimum and maximum adjustments, the arm 8 can oscillate—contrasted only by the action of the spring 12—so as to adapt itself to the thickness tolerances of the strap during its feeding, as better specified hereinafter.

Such an arrangement of the arm 8 essentially allows a double movement of oscillation:

a) the arm 8 of all rotatable about the shaft 5, with a possibility of oscillation which, as said, is limited by the interaction of its tailpiece 8*a* with the stops 13 and 14: said oscillation practically represents a slight slack—substantially free, or merely limited by the weak spring 12—which the arm 8 has in order to allow the free sliding of the strap R into the channel C3-C4, without any risks of jamming, in spite of the inevitable thickness tolerances of said strap;

b) the arm 8 can moreover oscillate, anticlockwise, beyond the slack allowed by the spring 12; in fact, when the tailpiece 8*a* bears against the stop 13, said arm further oscillates about the axis 7, together with the plate 6 and the bracket 9 and against the action of the spring 10, releasing the contact pressure of the wheel 4 against the wheel 1.

Figure 2:
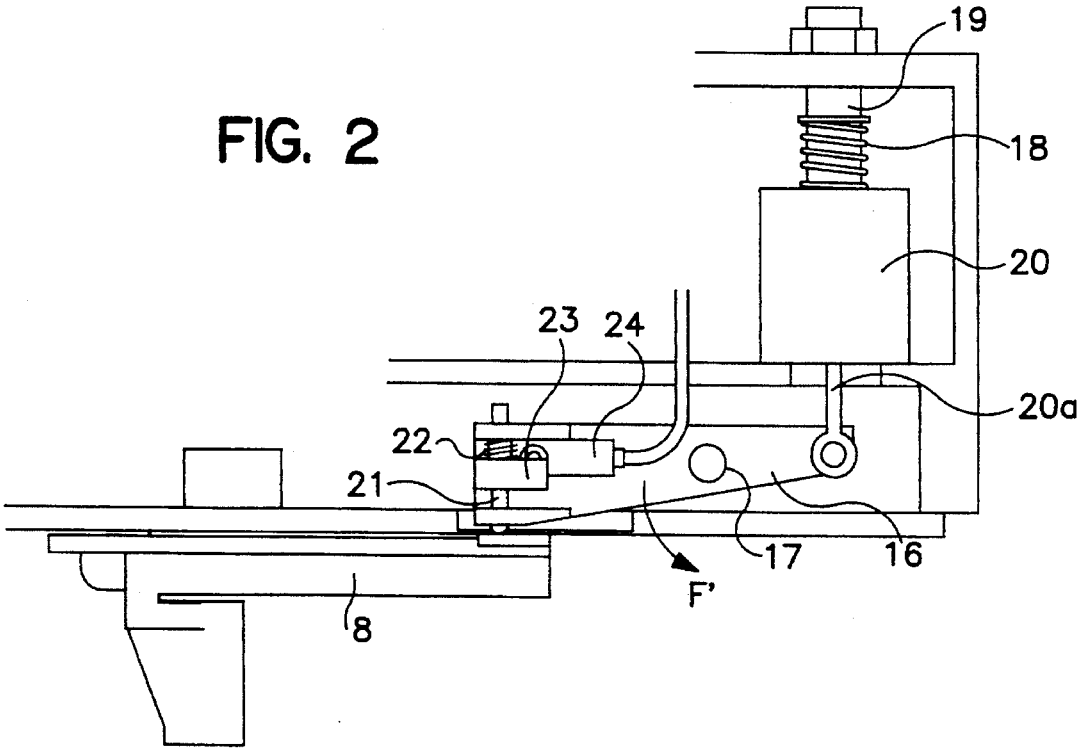
FIG. 2 is a top view of the system to lock the oscillating arm of FIG. 1.

A locking system is also provided in complete the aforedescribed device. This locking system essentially comprising a lever 16 oscillating about a vertical pin 17; a spring 18 presses the core 20*a* of an electromagnet 20 against an adjustable stop 19, thereby causing the anticlockwise rotation of the lever 16, as indicated by the arrow F' in FIG. 2.

On the end of the lever 16, opposite to that connected to the core 20*a*, there is mounted a pawl 21 sliding perpendicularly to the plane of oscillation of the arm 8, under the action of a pressure spring 22. A finger 23 is fixed on the pawl 21, said finger controlling a microswitch 24, as better described hereinafter.

The aforedescribed device works as follows: when, at the end of the launching stroke, the strap R reaches with its leading end a fixed stop (not shown), it is blocked at this end; nevertheless, under the thrusting action of the driving means, its intermediate length undergoes a bending—forming a loop—in correspondence of the only yielding point of the guiding channel, that is, along its section C3-C4 in correspondence of the arm 8. Arm 8 is then caused to oscillate anticlockwise, up to the position shown in FIG. 3.

Figure 3:
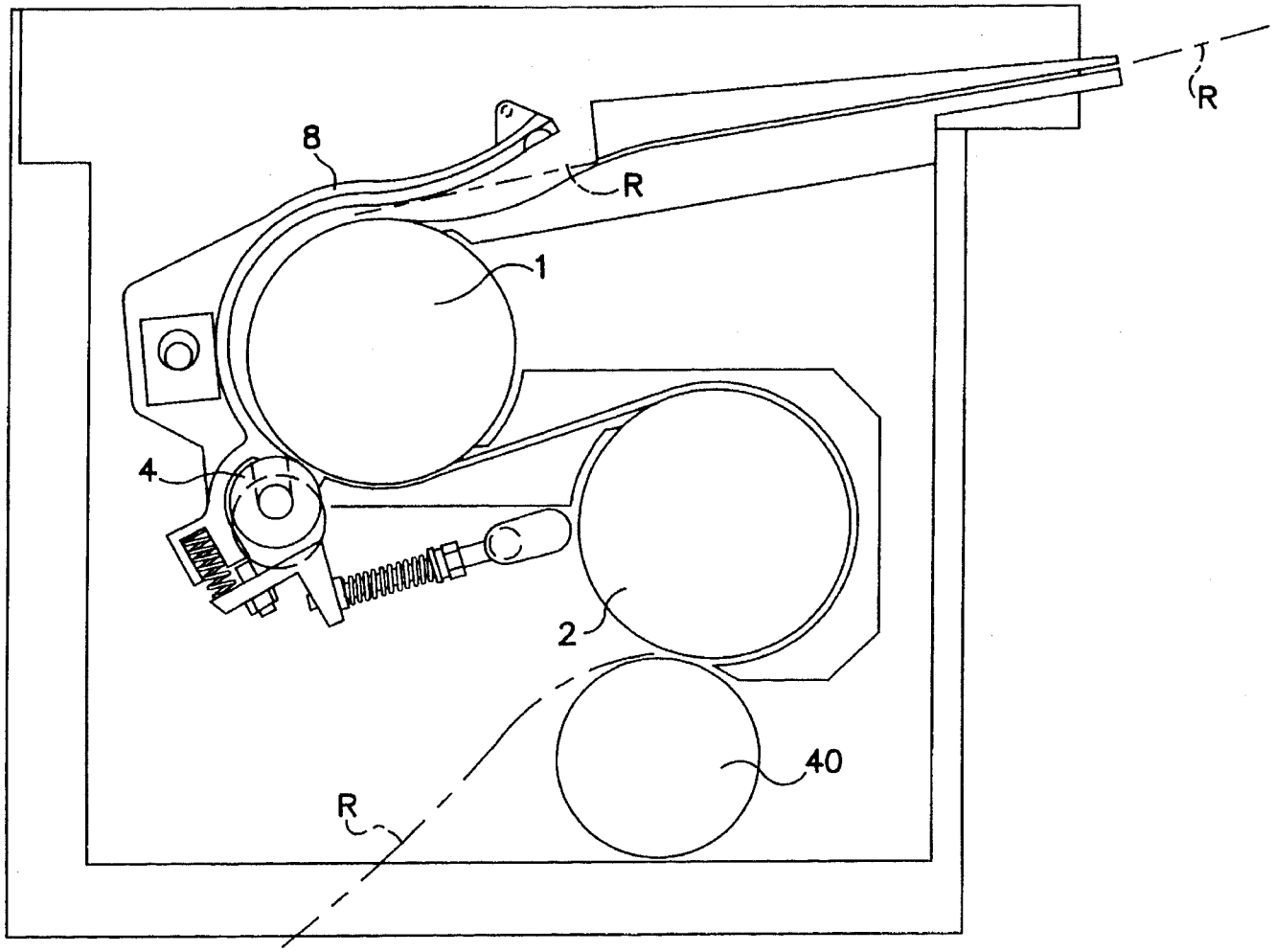
FIGS. 3 and 4 are views fully similar to those of FIGS. 1 and 2, but with the control device in a position of release at the end of strap recovery.
Figure 4:
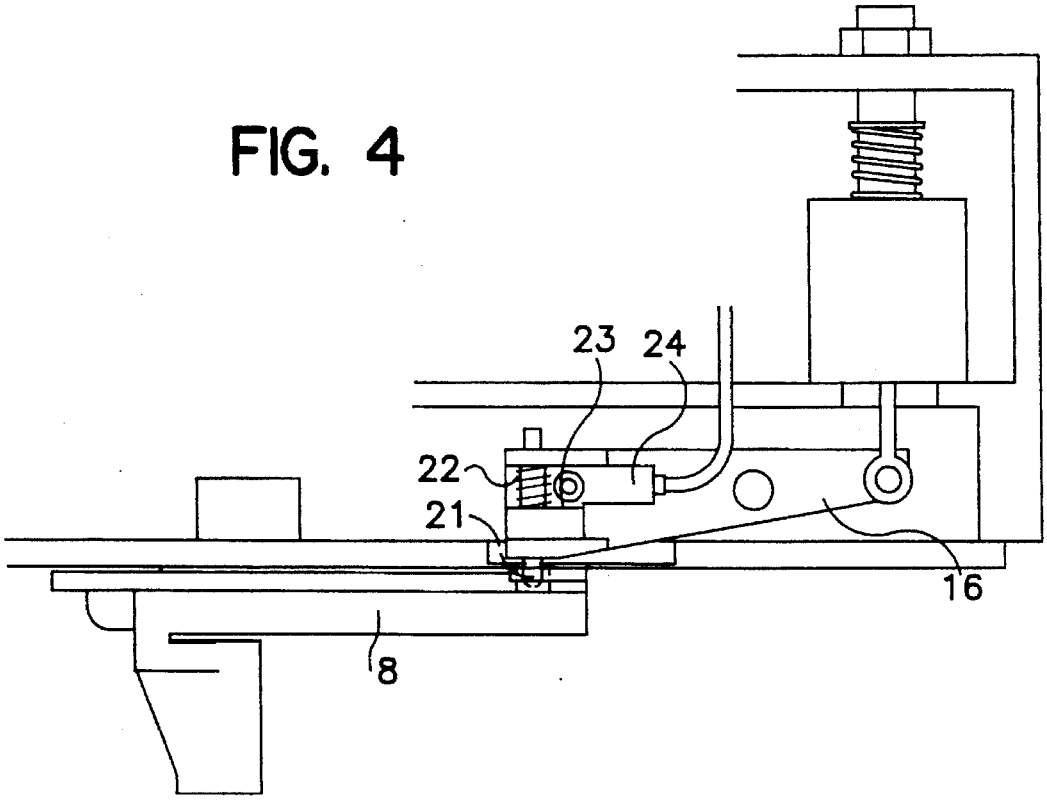

Likewise when, at the end of the recovery stroke, the strap is put under tension due its tightening around the product to be packed, said strap positions itself along the chord of the saddle path C4, thereby causing again the arm 8 to oscillate anticlockwise towards the position of FIG. 3.

In both these cases, the oscillation is ample enough for the arm 8 to carry its end cavity 8' in correspondence of the locking pawl 21. Locking pawl 21, under the thrust of spring 22, engages into said cavity 8' and locks the arm 8 in the reached position (being its opening position of release shown in FIG. 3). The engagement of the pawl 21 also causes the operation of the microswitch 24, which controls the stopping of the drive motor.

Said oscillation up to the position of FIG. 3 is also ample enough for the arm 8, after having led the tailpiece 8*a* to bear against the stop 13, to cause the whole unit of the bracket 9, plate 6, shaft 5 and wheel 4, to oscillate anticlockwise about the axis 7, against the action of the spring 10. This determines—as said —the parting of the pressure wheel 4 from the periphery of the driving wheel 1, leaving the strap R substantially free.

Thus, even if the wheel 1 continues to rotate by inertia, the removal of the wheel 4 from its periphery prevents a further drawing of the strap. In other words, this arrangement allows to free the strap R from the drawing action of the wheel 1 in the very instant in which said strap undergoes a being sufficient to allow the oscillation of the arm 8, and this quite independently from how long it takes for the wheel 1 to stop, due to the inertias involved, in respect of the instant in which the microswitch 24 operates to stop the drive motor.

Figure 1:
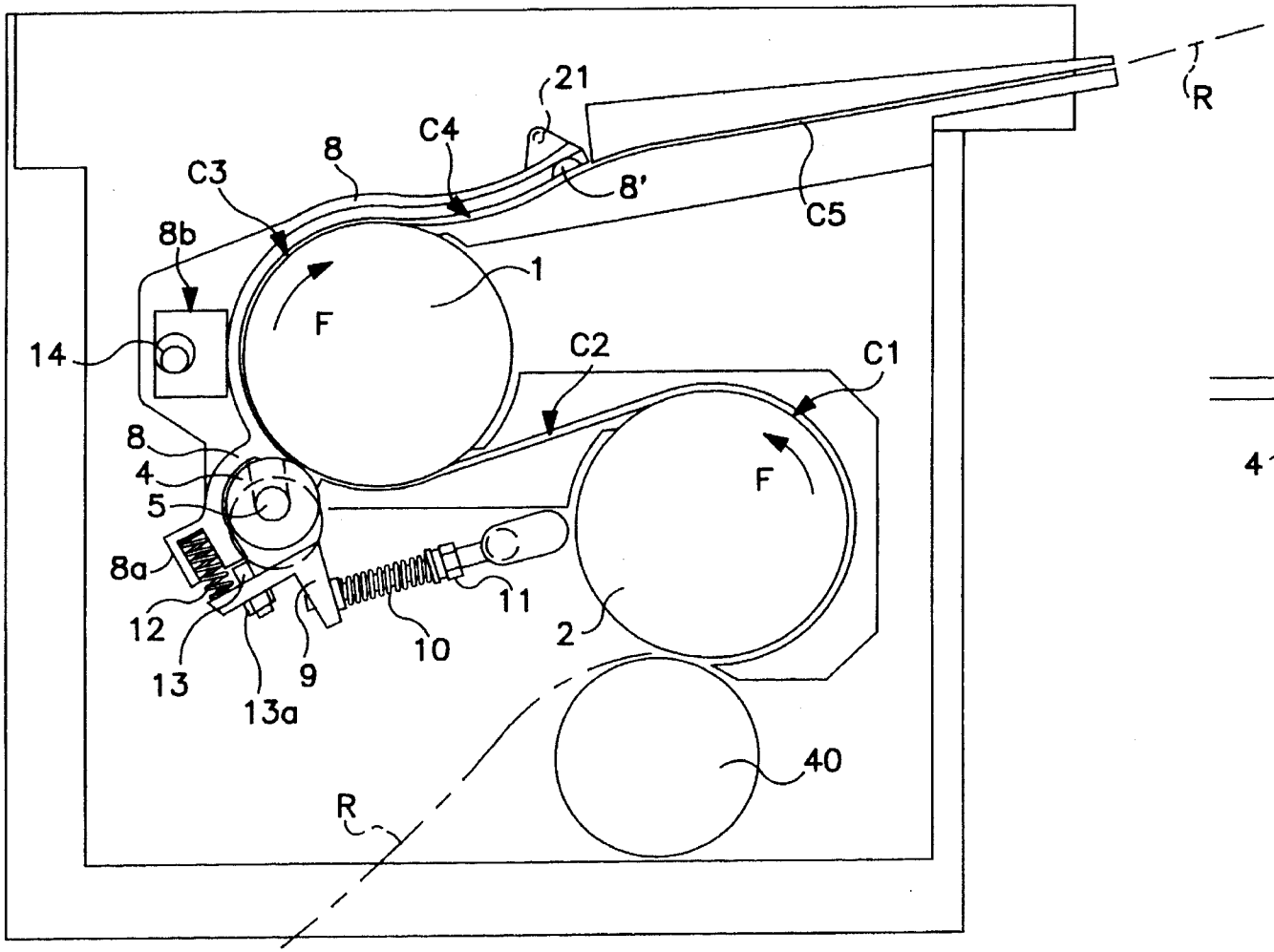
FIG. 1 is a front elevation view of the driving head of a strapping machine, comprising the device to control the feeding of the strap according to the invention.
Figure 5:
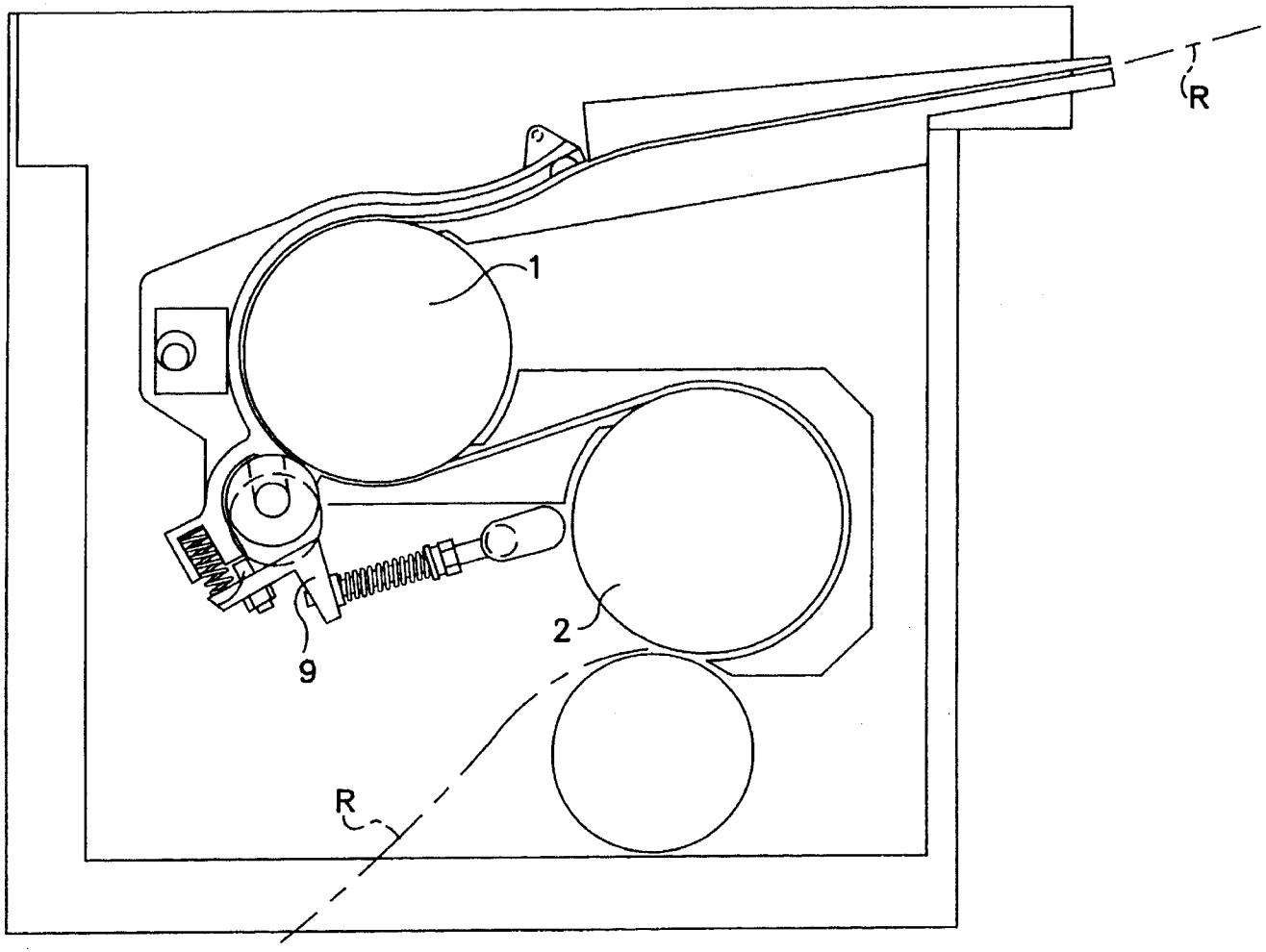
FIGS. 5 and 6 are also views similar to those of FIGS. 1 and 2, but with the control device in a reset position.
Figure 6:
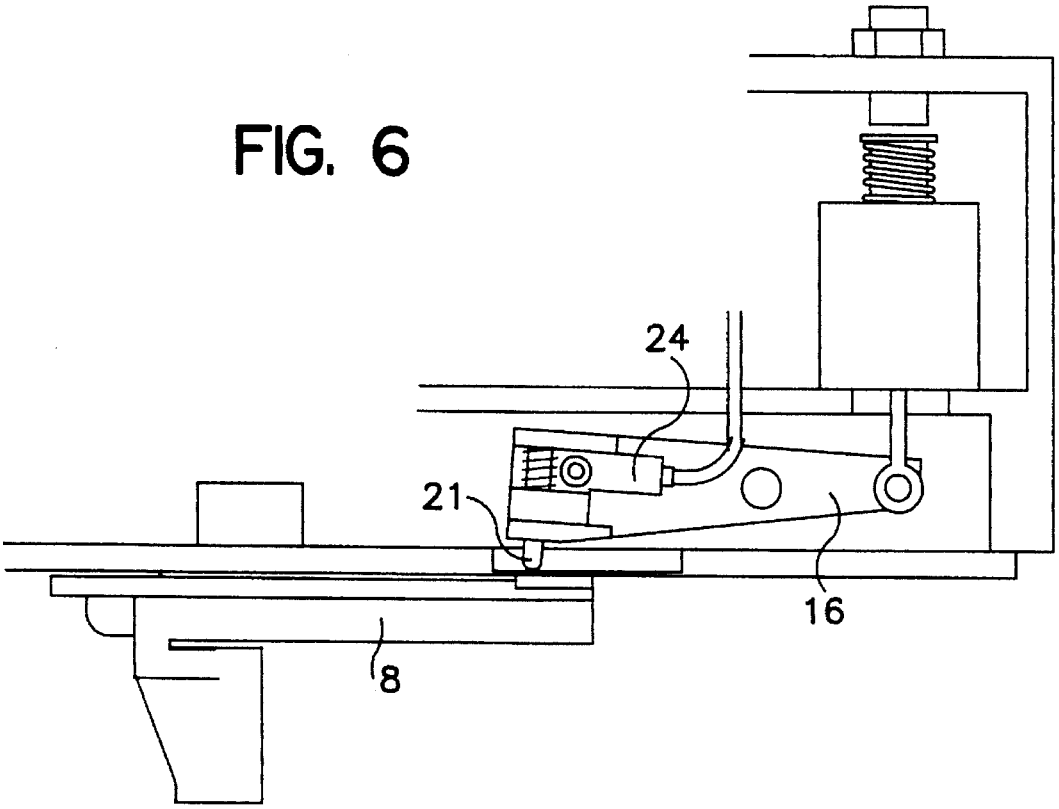

To reset the working position of FIG. 1, one operates the electromagnet 20, which causes the anticlockwise oscillation of the lever 16 up to releasing the pawl 21 from the cavity 8' of the arm 8 (position of FIGS. 5 and 6): the arm 8 then returns to its working position, under the thrust of the springs 10 and 12, while the pawl 21, under the thrust of its spring 22, returns to its initial position, releasing the finger 23 from the microswitch 24. The release of the electromagnet 20 also allows the lever 16 to return to its initial position of FIG. 2.

It is anyhow understood that the invention is not limited to the particular embodiment described heretofore, which merely forms a non-limiting example thereof, but that many modifications can be introduced, all within reach of a technician skilled in the art, without thereby departing from the scope of the invention itself.

I claim:

1. A device to control feeding of a strap in a strapping machine of the type wherein said strap (R) is guided on a periphery of at least one driving wheel (1) and at least one pressure wheel (4), said at least one pressure wheel (4) is provided to press said strap (R) against the periphery of said driving wheel (1) so as to secure proper feeding , said device comprising:

an arm (8) oscillating between a guiding position and an opening position and an opening position;

wherein in said guiding position, said arm (8) at least partly surrounds the periphery of said driving wheel (1) so as to form a guiding channel (C3) for said strap (R);

said arm (8) being movable by said strap to its opening position, means responsive to movement of said arm (8) to its opening position for controlling the stopping of said driving wheel (1); and said at least one pressure wheel (4) is associated with said oscillating arm (8) such that the at least one pressure wheel (4) is moved away from said driving wheel (1), so as to release a feeding pressure when said arm (8) is moved to its opening position.

2. Control device as in claim 1, wherein said oscillating arm (8) moves into said opening position at the end of a strap launching stroke by creating a loop formed by the strap (R) between the periphery of the at least one driving wheel (1) and said oscillating arm (8), said loop moving said arm (8) to its opening position.

3. Control device as in claim 1, wherein said oscillating arm (8) extends away from the periphery of the driving wheel (1), into a counter-bent portion which determines a saddle path (C4) for the strap (R).

4. Control device as in claim 1, wherein the arm (8) is mounted for pivoting movement about a main pivoting axis (7), and wherein said pressure wheel (4) is mounted rotatably about a shaft (5), connected to the oscillating arm (8), in a position close to the main pivoting axis (7).

5. Control device as in claim 4, wherein the oscillating arm (8) and said at least one pressure wheel (4) are mounted on a plate (6) rotating about said main pivoting axis (7), the oscillating of said arm (8) towards the opening position causing the rotation of said plate (6) and the parting of the at least one pressure wheel (4) from the at least one driving wheel (1).

6. Control device as in claim 5, further including a bracket (9) fixed to the plate (6), and wherein with said bracket (9) there are associated spring means (10) to control the feeding pressure of said at least one pressure wheel (4).

7. Control device as in claim 6, and further including means (11) for adjusting the force of said spring means (10).

8. Control device as in claim 5, the shaft (5) is eccentric with respect to the main pivoting axis (7) and wherein said oscillating arm (8) is mounted for rotation about the axis of the shaft (5).

9. Control device as in claim 8, wherein said oscillating arm (8) is mounted on said shaft (5) with a slight oscillation amplitude, sufficient to determine a minimum and, respectively, a maximum opening of the guiding path for the strap (R) along said at least one driving wheel (1), said amplitude being defined between a minimum opening stop, anchored to a fixed part of the machine, and a maximum opening stop anchored to said plate (6).

10. Control device as in claim 9, wherein said minimum opening stop consists of a cam (14) engaged into a wide slot (**8*b*) of said oscillating arm (8), the position of said cam (14**) being adjustable so as to regulate said minimum opening.

11. Control device as in claim 9, wherein said maximum opening stop consists of a finger (13) cooperating with a tailpiece (**8*a*) of said oscillating arm (8), the position of said finger (13**) being adjustable so as to regulate said maximum opening.

12. Control device as in claim 11, wherein with said tailpiece (**8*a*) of the oscillating arm (8) there is moreover associated a spring (12**) to return said arm to the position of minimum opening.

13. Control device as in claim 1, comprising moreover a locking pawl (21) to stop the oscillating arm (8) in its opening position.

14. Control device as in claim 13, wherein said locking pawl (21) is mounted on an oscillating lever (16) with the interposition of a spring (22) for pushing said pawl into a position to stop said oscillating arm (8), a return means being associated with said oscillating lever (16) to return said pawl (21) into a position of release.

15. Control device as in claim 14, wherein said return means associated with the oscillating lever (16) comprises of an electromagnet (20).

* * * * *